US005715960A

United States Patent [19]

Seymour

[11] Patent Number: 5,715,960

[45] Date of Patent: Feb. 10, 1998

[54] CONTAINER WITH RAMP ACTION CLOSURE

[75] Inventor: Richard William Seymour, Fulham, England

[73] Assignee: SmithKline Beecham p.l.c., Brentford, United Kingdom

[21] Appl. No.: 318,613

[22] PCT Filed: Apr. 6, 1993

[86] PCT No.: PCT/GB93/00724

§ 371 Date: Oct. 6, 1994

§ 102(e) Date: Oct. 6, 1994

[87] PCT Pub. No.: WO93/21079

PCT Pub. Date: Oct. 28, 1993

[30] Foreign Application Priority Data

Apr. 10, 1992 [GB] United Kingdom ..... 9207987

[51] Int. Cl.[6] ..... B65D 43/10

[52] U.S. Cl. ..... 215/295; 215/318; 220/288

[58] Field of Search ..... 220/281, 286, 220/288, 293, 294; 215/321, 318, 295

[56] References Cited

U.S. PATENT DOCUMENTS

| | | | |
|---|---|---|---|
| 3,252,446 | 5/1966 | Bateman | 215/295 |
| 3,826,397 | 7/1974 | Atkins | 215/295 |
| 3,828,962 | 8/1974 | Atkins | 215/31 X |
| 3,904,063 | 9/1975 | Hauser | 215/321 X |
| 3,910,444 | 10/1975 | Foster | 215/318 X |
| 4,586,623 | 5/1986 | Hatakeyama et al. | 220/281 X |
| 4,858,777 | 8/1989 | Morel | 215/295 |
| 4,967,921 | 11/1990 | Pré et al. | 215/295 |

FOREIGN PATENT DOCUMENTS

| | | |
|---|---|---|
| 304 290 | 11/1972 | Austria . |
| 67416 | 3/1927 | Denmark . |
| 1180669 | 10/1964 | Germany . |
| 2 130 098 | 12/1972 | Germany . |
| 8710 784 | 3/1988 | Germany . |
| 1 260 128 | 1/1972 | United Kingdom . |

*Primary Examiner*—Allan N. Shoap
*Assistant Examiner*—Robin A. Hylton
*Attorney, Agent, or Firm*—Janice E. Williams; Edward T. Lentz

[57] ABSTRACT

A container and closure combination wherein the closure comprises a skirt portion, the periphery of which has at least one rounded ramped portion adapted to cooperate with one or more corresponding rounded ramped portions on the container such that relative axial rotation of the container causes cooperation of the ramped portions and disengagement of the closure from the container.

8 Claims, 3 Drawing Sheets

CONTAINER WITH RAMP ACTION CLOSURE

This invention relates to containers and closures therefor, and especially to a container/closure combination wherein the closure is removed from the container by a rotational movement followed by an axial movement.

BACKGROUND OF THE INVENTION

GB 2,063,226 describes a closure and container combination wherein the closure is provided internally with a plurality of projections of equal circumferential length spaced apart by equal circumferential distances and the container is provided around its neck with a plurality of projections defining spaced slots therebetween, which slots have a circumferential length and are so positioned that the projections on the closure may pass through the slots on the container neck, or a skin of the closure and the container neck being shaped such that contact between the said skirt and the container neck when the container and closure are at selected relative rotational positions thereof causes the said skin of the closure to be temporarily deformed whereby the projections on the closure are urged through the slots on the container neck.

GB 1,471,367 describes a container and closure combination comprising a container having a rigid neck terminating in an annular bead provided with an upper sealing surface and an annular shoulder surface arranged substantially parallel to the upper sealing surface and facing downwardly away from the latter, the shoulder surface extending laterally inwardly towards a bore in the said neck, said neck being provided with peripheral bulges, said bulges being substantially crescent-shaped viewed from the end of the neck; and a closure having a rigid end portion and a resilient skirt, said skirt being provided with inside hooks engaged with the shoulder surface of said bead and with inner lugs adapted to engage the peripheral bulges on relative rotation of said closure and said container.

SUMMARY OF THE INVENTION

This invention provides a container and closure combination wherein the container comprises a body, a neck portion defining a mouth opening, between the neck and the body there being a shoulder portion, between the shoulder portion and the body there being a ledge portion integrally formed as a moulding of the container, the cross-sectional shape of the container and of the closure at the point where the periphery of the skirt of the closure meets the body of the container being substantially oval, the closure comprises a skirt portion the periphery of which substantially conforms to the cross-section of the container at the point where the periphery meets the body of the container, the periphery of the said skirt having at least one rounded ramped portion adapted to cooperate with at least one corresponding rounded ramped portion on the container the said ramp portion being provided by the said skirt having a scalloped periphery, and the said ledge portion of the container being of corresponding scalloped shape, such that when the closure is in place on the container the convex portions of the periphery of the closure intermesh with corresponding concave portions of the ledge portion and vice versa such that relative axial rotation of the closure and container causes the convex portions of the scalloped periphery of the closure to ride up the curve of the concave portions of the scalloped ledge portion of the container to cause a consequential relative longitudinal movement of the closure and container such as to cause disengagement of the closure from the container.

DESCRIPTION OF THE PREFERRED EMBODIMENT

Figure 1:
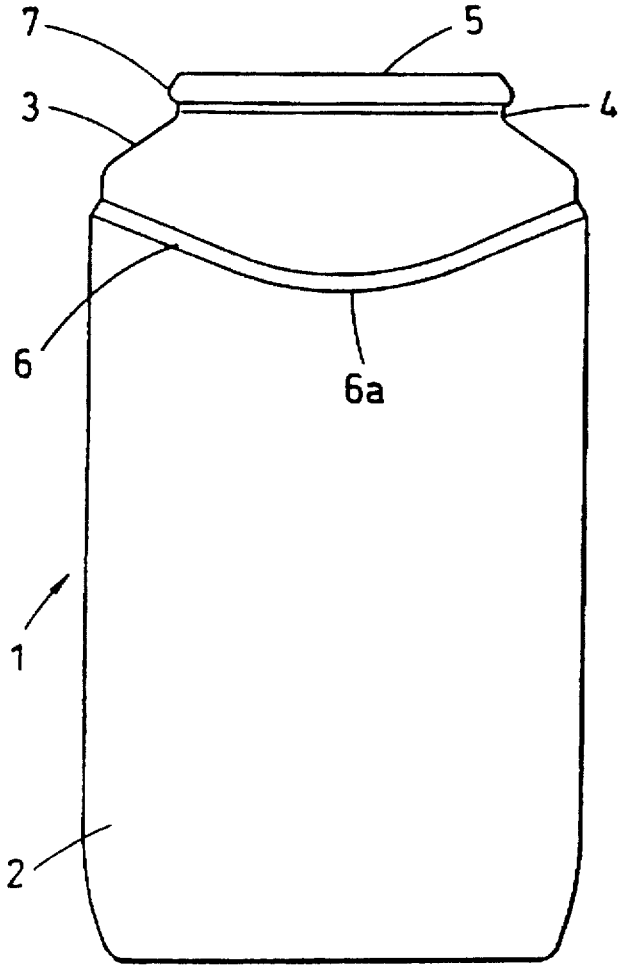
FIG. 1 is a front elevation of the container.

According to the present invention there is provided a container and closure combination wherein the closure comprises a skin portion the periphery of which substantially conforms to the cross-section of the container at the point where the periphery meets the container, the periphery of the said skin having at least one rounded ramped portion adapted to cooperate with one or more corresponding rounded ramped portions on the container such that relative axial rotation of the closure and container results in cooperation of the respective ramped portions on the periphery of the closure skirt and container and a consequential relative longitudinal movement of the closure and container such as to cause disengagement of the closure from the container.

The cross-sectional shape of the container and hence of the substantially conforming closure at the point where the periphery of the skirt of the closure meets the container, is suitably substantially oval or obloid. Suitably for manufacturing and handling convenience the cross sectional shape may be substantially oval but with flattened end faces substantially parallel to the minor axis of the oval. Typically the oval may have minor and major axis lenghts in the ratio 1:1.2–1.5, suitably about 1:1.33.

It should be appreciated that the exact shape of the container and closure may be varied provided that the cross-sectional shape of the closure skirt portion substantially conforms to the cross-section of the container in such a way that there is means for engaging the closure and the container and that they can be disengaged by the herein described cam action upon each other.

The container is suitably made of glass or plastic such as high density polypropylene. Preferably the container is made of glass. The closure is suitably made from a resilient material such as plastic for example polyethylene.

In a preferred embodiment, ramped portion(s) on the periphery of the skirt of the closure is/are provided by a skirt having a scalloped periphery, and the corresponding ramped portion(s) on the container is/are provided by a ledge or shelf portion integrally formed as a moulding of the container, of corresponding scalloped shape, such that when the closure is in place on the container the convex portions of the periphery of the closure intermesh with corresponding concave portions of the ledge or shelf and vice versa. In such an embodiment relative axial rotation of the closure and container causes the convex portions of the scalloped periphery of the closure to ride up the curve of the concave portions of the scalloped portion of the container, thereby functioning as co-operating ramp portions. Suitably the scalloped periphery of the closure may have two convex portions and two concave portions, and corresponding portion being formed on the container.

In a closure which is substantially oval, these convex portions may suitably be formed so that their peaks are positioned opposite each other and bisected by the minor axis of the oval, with a corresponding ledge or shelf portion being formed on the container.

The closure suitably has a closure face which when the closure is in place on the container seals the mouth opening of the container. The closure may include a conventional sealing wad, e.g to e.g. of paper, card, plastics etc. to improve the seal, e.g to make it air or moisture tight.

Engagement of the closure with the container is suitably achieved by a 'snap-fit' mechanism. The container suitably has a longitudinal extending neck, which may suitably be circular in cross section the open mouth of which may co-operate with the closure face of the closure. The container suitably has a whole or segmented annular bead around the neck of mouth opening, suitably immediately adjacent to the mouth opening, and the closure suitably has internal resilient lugs which snap over the annular bead thereby providing a 'snap-fit'. These lugs may be mounted upon the inner face of the skirt, but are preferably mounted on one or more projections from the closure face of the closure, these projections being aligned in the axial direction of the container. By mounting the lugs on such projections the opening and hence the neck of the container may be made of a different shape to the body of the container, for example the mouth opening and/or may be circular in section whilst the body is substantially oval or obloid or oval with flattened end faces. Snap-fit mechanisms of this type are generally known in the art, for example in GB 2063226. Alternative snap-fit mechanisms will be apparent to those skilled in the art.

Alternatively, the engagement of the closure with the container may suitably be achieved by a 'friction-fit' wherein a portion of the closure is in very close contact with the container thereby engaging them together so that some force is needed to disengage them.

Disengagement of the closure from the container is suitably effected by the cooperation of the ramped portions on the container and the corresponding ramped portions on the periphery of the skirt of the closure. Thus, when the closure and container are rotated relative to each other about the longitudinal axis of the container the closure is forced apart from the container by cam action until the closure is disengaged from the container, for example when the 'snap-fit' mechanism on the closure and container becomes disengaged or when the friction between the closure and container in the friction-fit is overcome.

Figure 2:
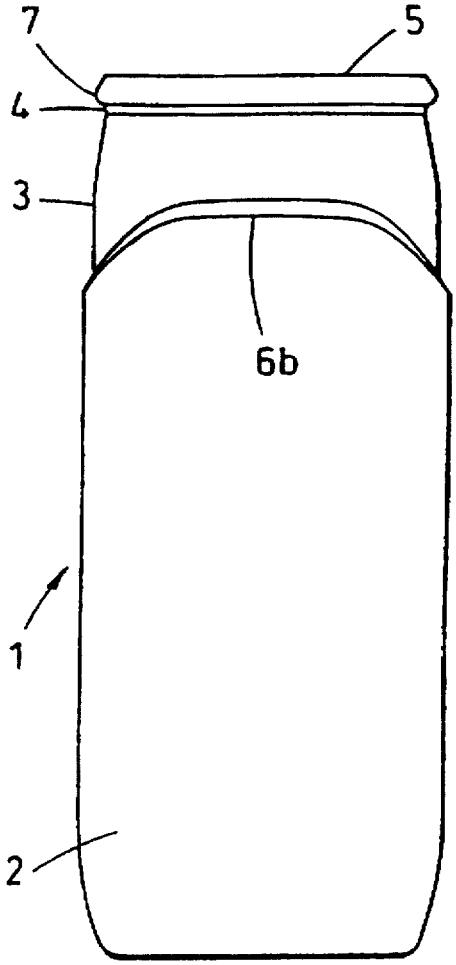
FIG. 2 is a side elevation of the container.
Figure 3:
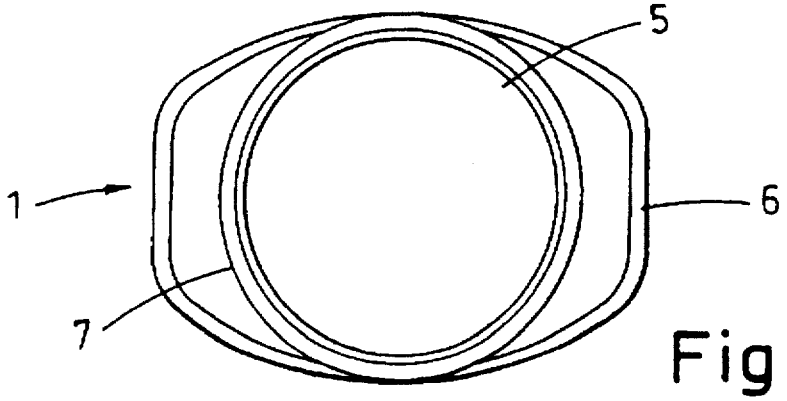
FIG. 3 is a plan view of the container.

With reference to FIGS. 1, 2 and 3, a glass container 1 has a body 2 of oval cross section having minor and major axes in a ratio 1:1.33 with flattened ends, a shoulder portion 3, and a neck portion 4 defining the mouth opening 5 of the container. Between shoulder portion 3 and body 2 is an integrally moulded ledge or shelf 6 of scalloped shape, with its concave portions **6*a* along the long sides of the oval and with its convex portions 6*b* at the ends of the oval. Around the neck portion 4, adjacent to mouth opening 5, is formed an annular bead 7**, completely surrounding the neck.

Figure 4:
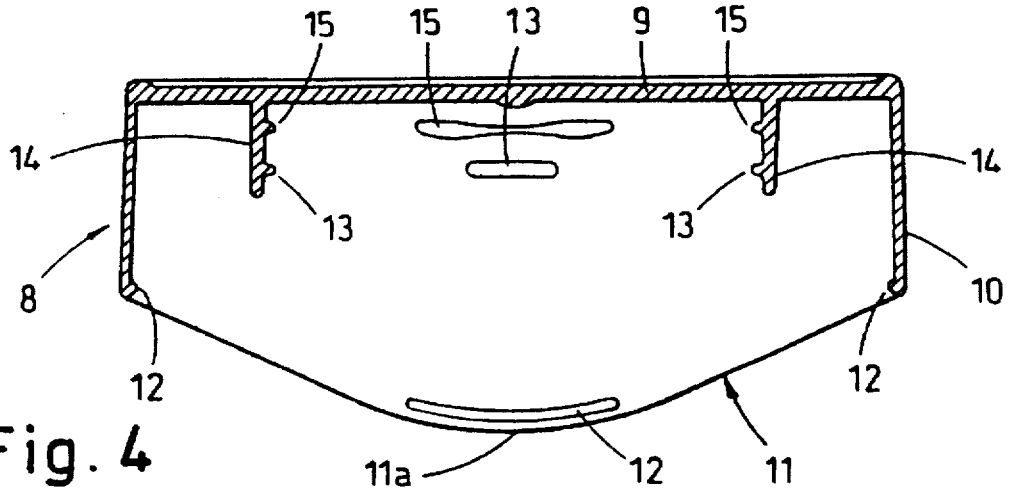
FIG. 4 is a sectional view of the closure cut along the major axis of the oval.
Figure 5:
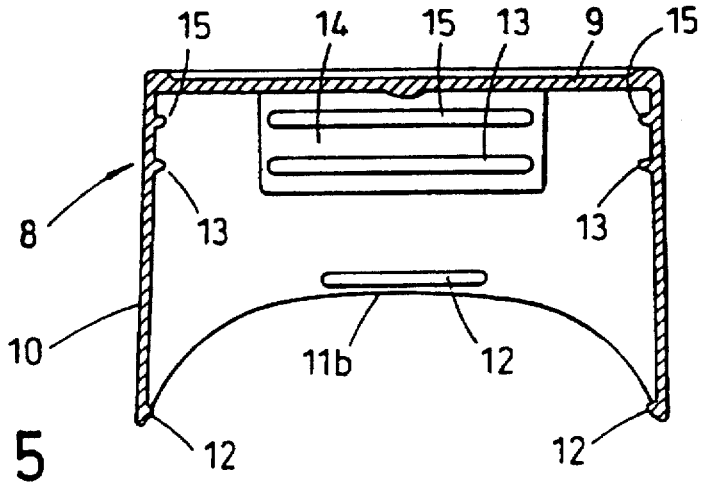
FIG. 5 is a sectional view of the closure cut along the minor axis of the oval.
Figure 6:
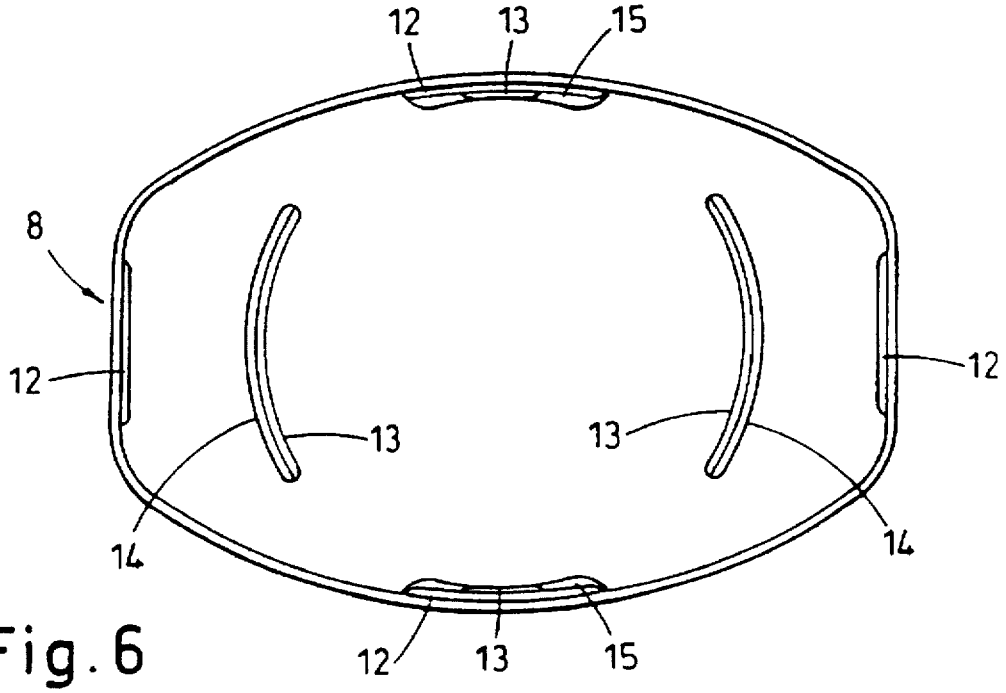
FIG. 6 is a view of the closure looking toward the inner side of the closure face.

Referring to FIGS. 4, 5 and 6, a closure 8 comprises a closure face 9, from which descends a skin portion 10. The sectional shape of the skirt portion 10 corresponds closely in shape to the section of the body 2 of container 1, ie. being oval with flattened ends. The skin portion 10 has a periphery 11 of scalloped shape, with two opposite convex portions **11*a* corresponding to concave portions 6*a* of the ledge 6, and two opposite concave portions 11*b* corresponding to convex portions 6*b* of the ledge 6. The skirt 10 is also provided with internal strengthening ribs 12 adjacent to the periphery 11**.

Internally the closure is provided with four lugs 13, two opposing pairs of which are located upon projecting portions 14 which project from closure face 9, the remaining two being located on the inner wall of the skin 10.

When the closure 8 is in place on the container 1, lugs 13 grip underneath the bead 7 and retain the closure in place on the neck 4, of the container 1. On projecting portions 14 and on the inner wall of skin 10 are projecting retainers 15 to retain in place a sealing wad (not shown) against closure face 9.

Figure 8:
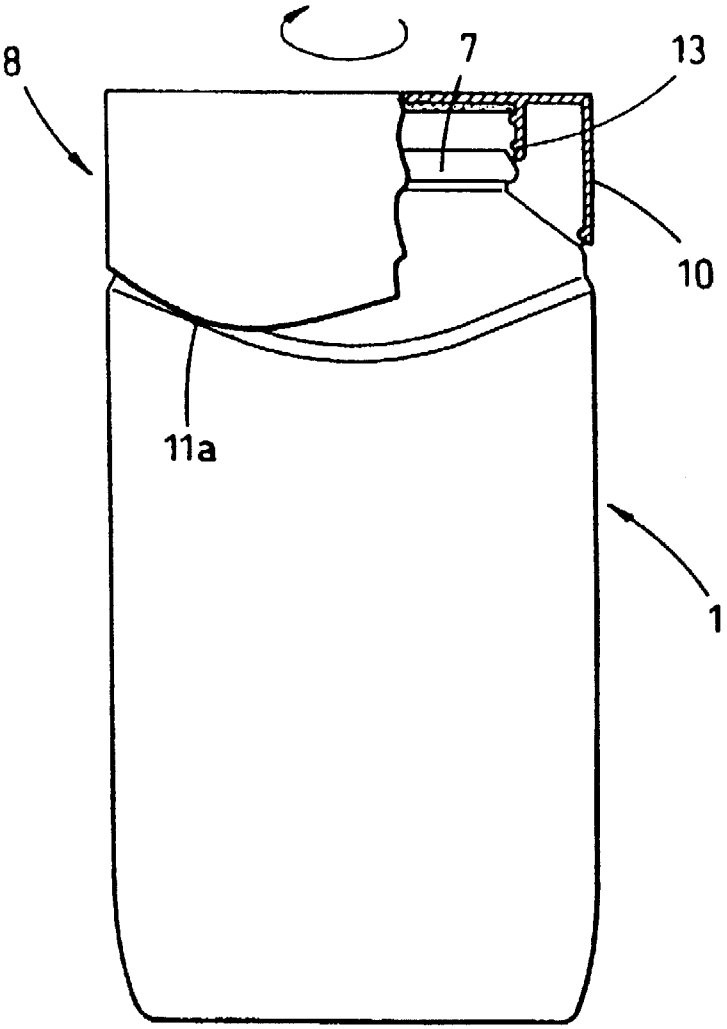
FIGS. 7 and 8 show the operation of the closure.
Figure 7:
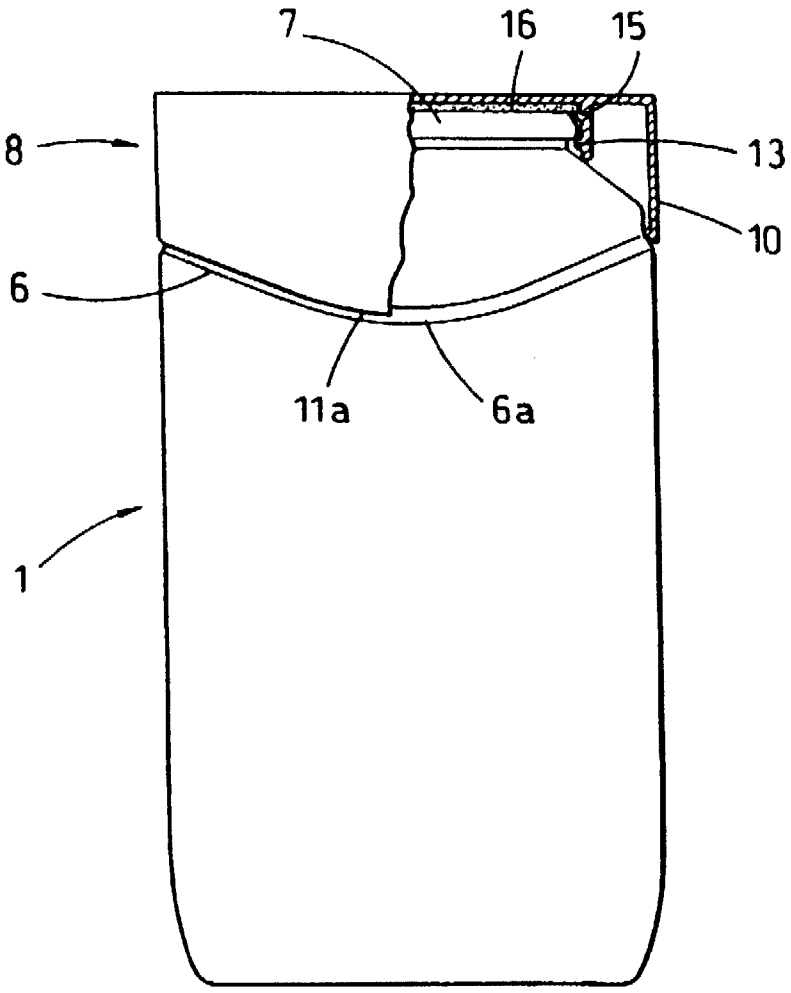

Referring to FIGS. 7 and 8, the operation of the closure 8 is shown. In FIG. 7 the closure 8 is shown in place on the container 1, with the convex portion **11*a* of the skirt 10 intermeshing with the concave portion 6*a* of ledge 6. The lugs 13 grip under the bead 7 and retain closure 8 in place on the container 1. A sealing wad 16 is shown retained by retainer 15 against the mouth 5 of the container. In FIG. 8 the closure 8 has been rotated about the axis of the container in the direction shown by the arrow, and the peak of the convex portion 11*a* of the skirt 10 has ridden up the ramp of the slope of the concave portion 6*a* of the ledge 6. This has caused the whole closure 8 to rise and has caused the lug 13 to snap over the bead 7 thus releasing the closure 8 from the container 1**.

The invention claimed is:

1. A container and closure combination wherein the container comprises a body, a neck portion defining a mouth opening, between the neck and the body there being a shoulder portion, between the shoulder portion and the body there being a ledge portion integrally formed as a molding of the container, the closure comprising a closure face and a skirt having a periphery descending therefrom, the cross-sectional shape of the container and of the closure at the point where the periphery of the skirt of the closure meets the body of the container being substantially oval and substantially conforming to each other, said said cross sectional shape having a major axis and a minor axis, the periphery of the skirt portion being in the form of a continuous series of alternating curves forming convex and concave portions respectively descending downwards to a greater and lesser distance from the said closure face, the shape of said ledge portion of the container corresponding to the shape of the periphery of said skirt portion such that when the capsule is in place, on the container the convex portions of the periphery of the closure intermesh with corresponding concave portions of the ledge portion and the concave portions of the periphery of the closure intermesh with corresponding convex portions of the ledge portion such that relative axial rotation of the closure and container in separating said container and closure from each other causes the said convex portions of the periphery of the closure and the said concave portions on the ledge portion to function as cooperating rounded ramp portions, such that the said convex portion on the periphery of the skirt portion rides up the curve of the concave portions of the ledge portion of the container, to cause a consequential relative longitudinal movement of the closure and container such as to cause disengagement of the closure from the container.

2. A container and closure combination according to claim 1 in which the cross sectional shape has flattened end faces substantially parallel to the minor axis of the oval.

3. A container and closure combination according to claim 2 characterised in that the cross-sectional shape is oval having minor and major axis lengths in the ratio 1:1.2–1.5, suitably about 1:1.33.

4. A container and closure combination according to claim 1 in which the periphery of the closure has two convex portions and two concave portions, and corresponding portions being formed on the container.

5. A container and closure combination according to claim 4 in which the convex portions are formed so that the points at which said convex portions are at their maximum descent from the closure face are positioned opposite each other and bisected by the minor axis of the oval with a corresponding ledge as shelf portion being formed on the container.

6. A container and closure combination according to claim 1 characterized in that the closure has a closure face which when the closure is in place on the container seals the opening of the container.

7. A container and closure combination according to claim 1 characterized in that the engagement of the closure with the container is achieved by a 'snap-fit' mechanism.

8. A container and closure combination according to claim 7 in which the 'snap-fit' is provided by annular bead around the neck of opening of the container and corresponding internal resilient lugs on the closure which snap over the bead.

* * * * *